US005475191A

United States Patent [19]

Doudon

[11] Patent Number: 5,475,191

[45] Date of Patent: Dec. 12, 1995

[54] ELECTRICAL SWITCH

[75] Inventor: Robert Doudon, Nicephore, Canada

[73] Assignee: Siemens Electric Limited, Mississauga, Canada

[21] Appl. No.: 222,772

[22] Filed: Apr. 4, 1994

[51] Int. Cl.[6] ..... H01H 1/44

[52] U.S. Cl. ..... 200/257; 200/260; 200/252; 200/254

[58] Field of Search ..... 200/257, 260, 200/261, 252, 254, 255, 256, 253, 258

[56] References Cited

U.S. PATENT DOCUMENTS

| | | | |
|---|---|---|---|
| 2,193,122 | 3/1940 | Crabbs | 200/255 |
| 2,747,060 | 5/1956 | Ballou | 200/261 |
| 3,137,778 | 6/1964 | Barr | 200/255 |

*Primary Examiner*—Andres Kashnikow

*Assistant Examiner*—David J. Walczak

*Attorney, Agent, or Firm*—Peter A. Luccarelli, Jr.

[57] ABSTRACT

An electrical switch (10) or fused switch for electrical distribution systems has a housing (12, 14); first and second spaced apart straps (16, 18), coupled to the housing; and a pair of opposed blades (22, 24) pivotally coupled to the first strap and straddling both straps. The blades (22, 24) are capable of relative pivotal movement from an open position spaced from the second strap to a closed position in contact therewith. A blade extension (30) is coupled to the blades between the straps. The switch has first and second biasing elements (26, 28), which may be leaf springs, each coupled to a respective blade, each of which biases the respective blade toward the first and second straps at a first bias force level when the respective blade is in the closed position and at a second, lower bias force level when the respective blade is in the open position. A fastener (32) slidably passes through each of the blades, the blade extension and the biasing elements.

20 Claims, 4 Drawing Sheets

ELECTRICAL SWITCH

BACKGROUND OF THE INVENTION

The present invention is directed to electrical switches suitable for application in a low voltage alternating current (600 V max) electrical distribution systems, such as for example 120 volts 60 Hz systems having a rated capacity of up to approximately 800 Amperes per pole.

So-called "knife blade" rotary and linear "quick-break" electrical switches in fused or unfused form are known in the electrical distribution industry. Respective examples of each type of switches are shown in U.S. Pat. Nos. 5,053,590 and 5,072,081. With respect to rotary switches, one or more pivotally mounted blades are pivotable from an open position to a closed position which enables electrical continuity from a line side of the switch to a load side of the switch. When the switch is in a closed position, the knife-blade establishes electrical continuity with a line strap. The strap also often includes one or more contact clips, comprising a strip of bent conductive metal. When in a closed position, the blade establishes biased contact with the line strap clip, in order to enable good electrical continuity.

Prior art knife-blade rotary and linear switch contacts can tend to weaken contact pressure between the blade and strap as the switch contact surfaces become warm. It would be desirable to maintain relatively constant contact pressure between electrical switch blades and line straps over the life of the switch. Another problem with existing and known knife-blade type electrical switches is that the pivoting side of the blade must also maintain good electrical continuity with a strap located attached thereto. In the past, in order to maintain such a conductivity between the strap proximal the pivot point and the blade structure it was necessary to construct a switch with a very tight fit. While the tight fitting pivot were ensured good electrical continuity, it would increase the physical effort necessary to pivot the switch blades from the on or closed to the off or open positions. Continuity of the pivot side of the blades could also possibly weaken due to wear in the switch.

It is an object of the present invention to create an electrical switch that maintains relatively constant blade and strap pressure even as the switch contact points wear during normal service life.

It is also an object of the present invention to create an electrical switch which maintains bias pressure on the pivoting side of the blades into contact with a respective line strap when the switch is in the closed or on position, yet which decreases the respective biasing pressure when the switch is being translated to the open or off position.

SUMMARY OF THE INVENTION

The above-described objects obtained by the electrical switch of the present invention, which maintains relatively constant blade-to-strap contact pressure, and thus assures good electrical continuity throughout the service life of the switch.

The electrical switch of the present invention also maintains electrical continuity between the pivoting side of the blades and the respective strap while the switch is in the on or closed position, thus assuring good electrical continuity; yet such bias pressure is decreased while the one or more contact switch blades are translated to the open or off position.

The electrical switch of the present invention features a housing; first and second spaced apart straps, coupled to the housing; at least one blade pivotally coupled to the first strap and capable of relative pivotal movement from an open position spaced from the second strap to a closed position in contact therewith; and a biasing element coupled to the blade, which biases the blade toward the first and second straps at a first bias force level when the blade is in the closed position and at a second, lower bias force level when the blade is in the open position.

Another aspect of the electrical switch of the present invention features a housing; first and second spaced apart straps, coupled to the housing; a pair of opposed blades pivotally coupled to and straddling the first strap, which are capable of relative pivotal movement from an open position spaced from the second strap to a closed position in contact therewith; and at least one biasing element, coupled to a respective blade, which biases the respective blade toward the first and second straps at a first bias force level when the respective blade is in the closed position and a second, lower bias force level when the respective blade is in the open position.

Yet another aspect of the electrical switch of the present invention features a housing; first and second spaced apart straps, coupled to the housing; a pair of opposed blades pivotally coupled to the first strap and straddling both straps, which blades are capable of relative pivotal movement from an open position spaced from the second strap to a closed position in contact therewith; a blade extension coupled to the blades between the straps; first and second biasing elements, each coupled to a respective blade, each of which biases the respective blade toward the first and second straps at a first bias force level when the respective blade is in the closed position and at a second, lower bias force level when the respective blade is in the open position; and a fastener slidably passing through each of the blades, the blade extension and the biasing elements.

DESCRIPTION OF THE PREFERRED EMBODIMENTS

Figure 1:
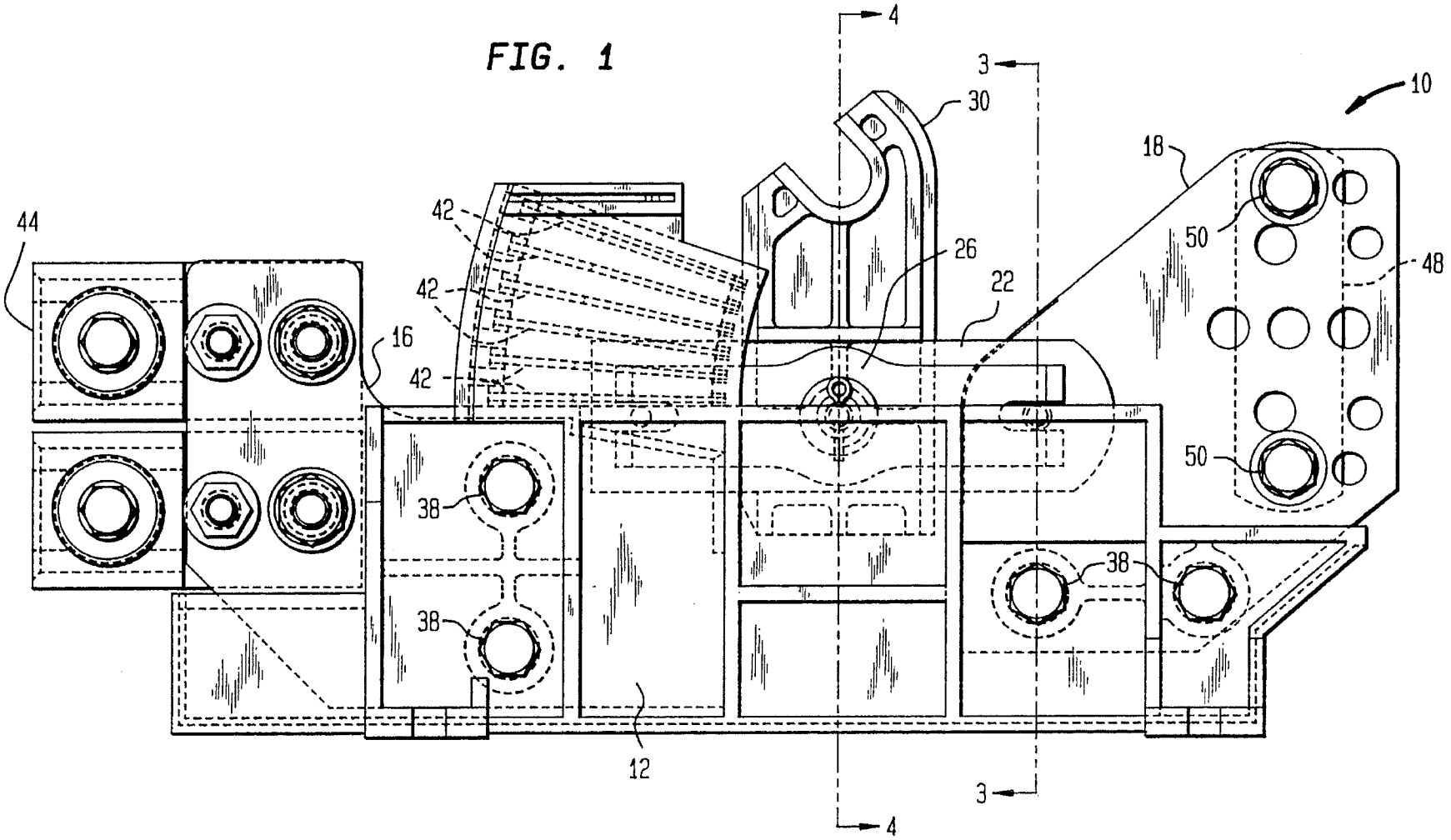
FIG. 1 is a side elevational view of the electrical switch of the present invention.
Figure 2:
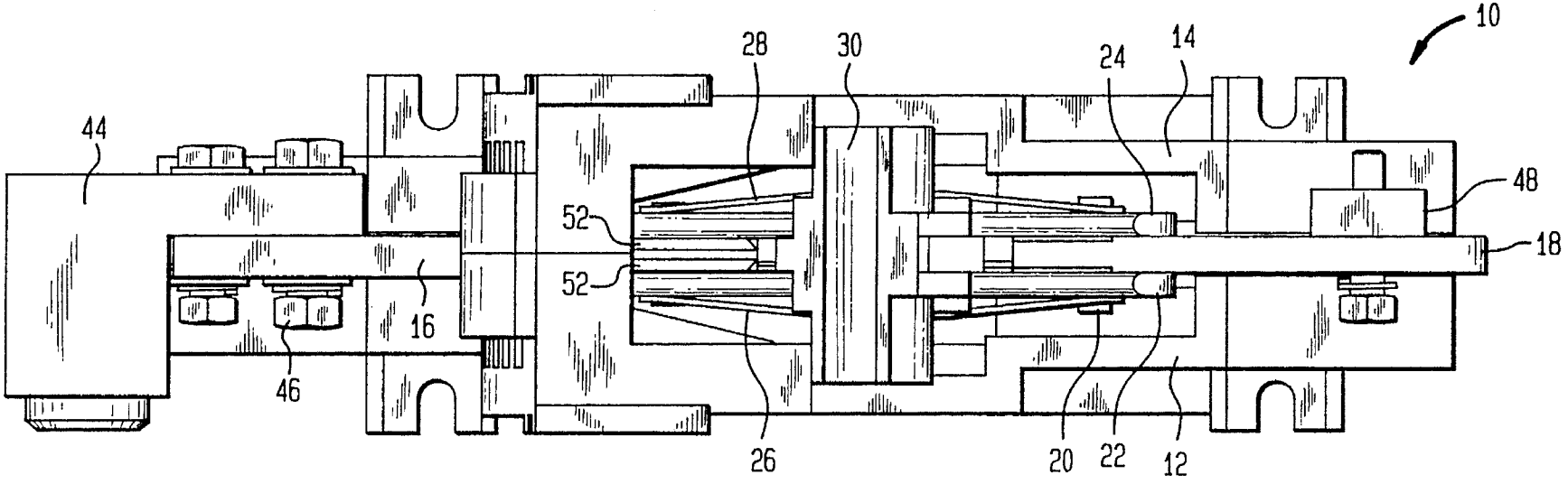
FIG. 2 is a top plan view of the electrical switch of the present invention.

Referring generally to FIGS. 1–5, the electrical switch 10 is suitable for application up to 600 volts alternating current electrical power distribution systems, which are commonly used throughout the world. Switch 10 shown in the Figures is suitable for 400 Amp to 800 Amp rating applications. While only a single phase of electric power can be serviced by switch 10 as can be appreciated by those skilled in the art, a plurality of switches 10 can be placed in a single enclosure for multi-phase applications.

Switch 10 has a left and right hand housing portions 12, 14, which may be constructed of any suitable insulating material known in the art, such as molded glass-filled thermoplastic or thermosetting plastic. Line side strap 16 conducts electric power from the power source (not shown) and load side strap 18 conducts electric power from the switch 10 to a load serviced by the switch (not shown). A load side pivot 20 is connected to load side strap 18, and it provides a pivot axis for respective left and right blades 22, 24. As shown in the preferred embodiment, the blades 22, 24 pivot from an "open" position, which means that the switch does not establish electrical power continuity from the line strap 16 to the load strap 18, to a "closed" position, wherein the blades 22, 24 are in electrical contact with both the straps 16, 18 and thus establish electrical power continuity from the line to the load sides of the switch 10.

It is preferable for good switch 10 performance that there be sufficient bias contact pressure between the straps 16, 18 and the respective portions of blades 22, 24 when the switch is in the "closed", electric power conducting position. Sufficient bias pressure should be maintained throughout the useful service life of the switch, even as contact surfaces wear. It is also preferable for the bias contact pressure between the straps 16, 18 and the blades 22, 24 be reduced when the switch is in the "open" position, so as to allow easier relative movement between the blades and straps.

Figure 4:
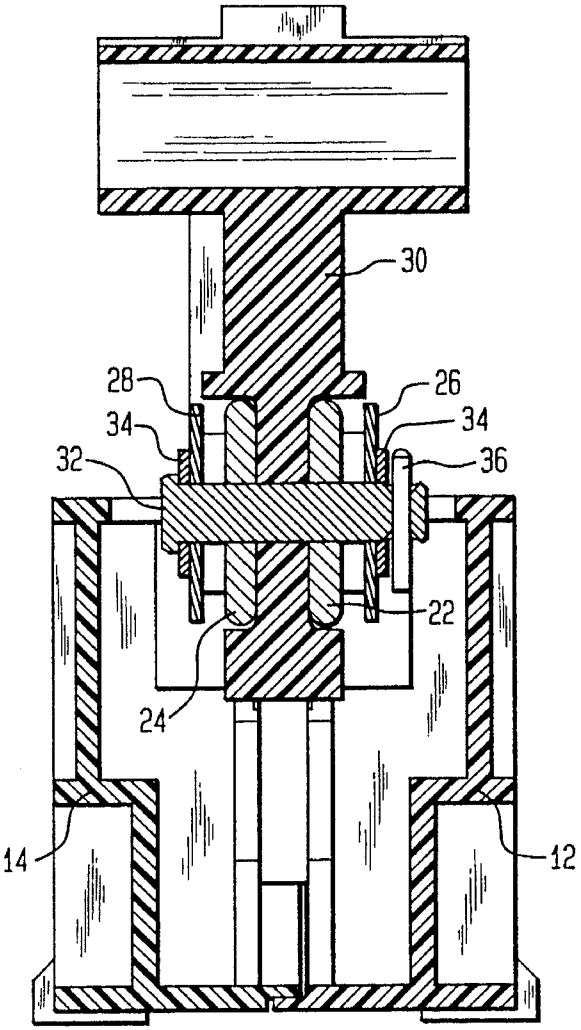
FIG. 4 is a sectional view taken along 4—4 of FIG. 1.
Figure 3:
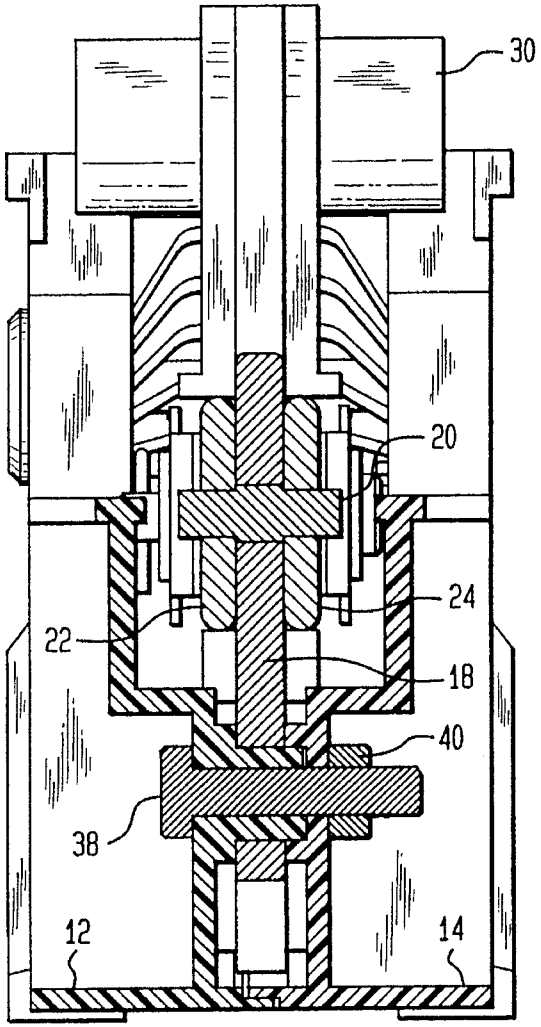
FIG. 3 is a cross-sectional view taken along 3—3 of FIG. 1.
Figure 5:
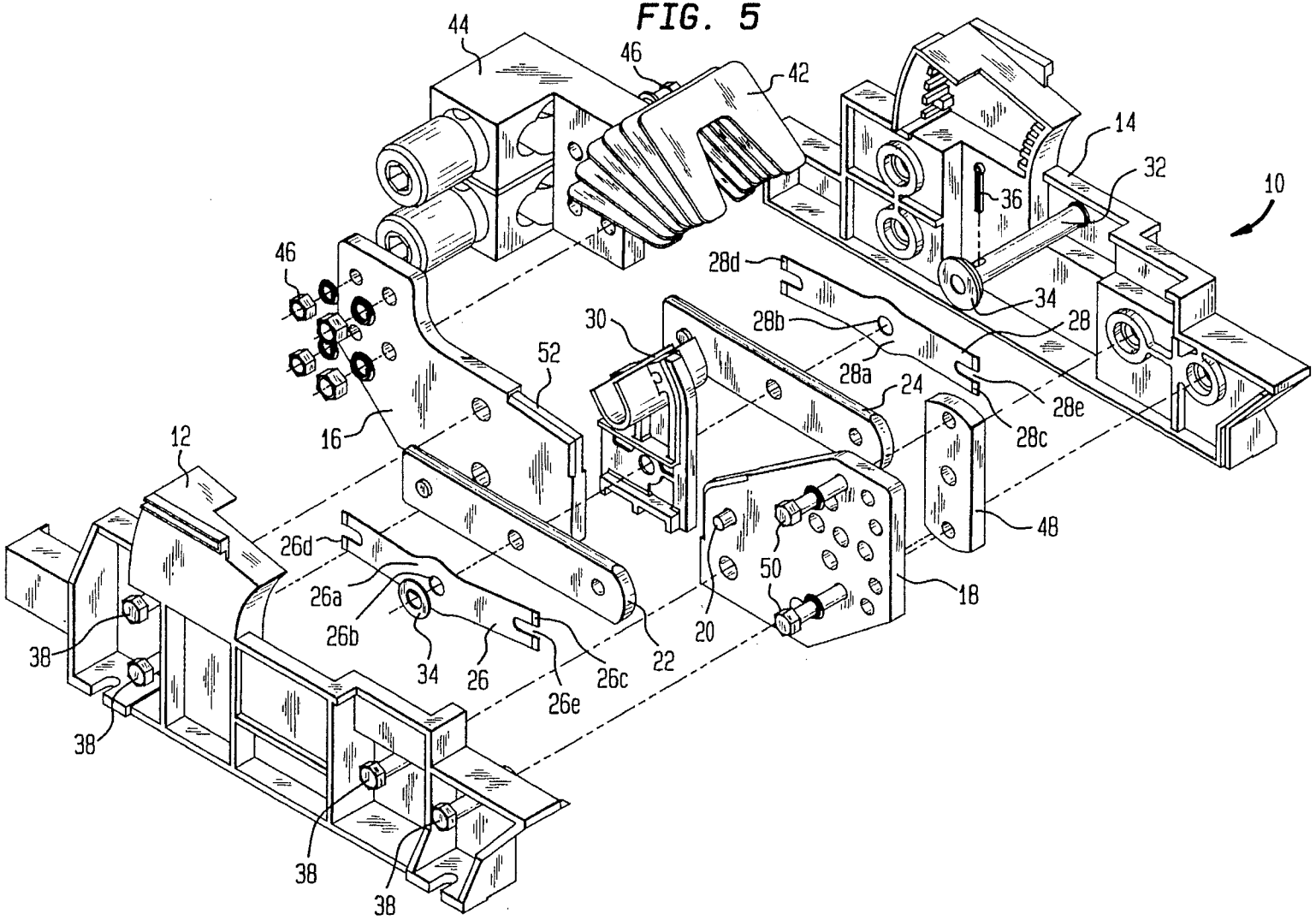
FIG. 5 is an exploded view of the electrical switch of the present invention.

As shown in FIGS. 4 and 5, the switch 10 has a pair of blade springs 26, 28, in contact with respective one of corresponding blades 22, 24. Each blade spring 26, 28 biases its corresponding blade 22, 24 inwardly, i.e., toward the straps 16, 18. The blade springs 26, 28 are coupled to the blades 22, 24 and a blade extension 30 by clevis pin 32 and corresponding washers 34 and cotter pin 36 or any device giving the same result. Each respective blade spring 26, 28 is preferably a leaf spring which has a central portion 26*a*, 28*a* which defines a bore 26*b*, 28*b* for passage of the clevis pin fastener 32 therethrough; and has a pair of legs projecting from the central portion thereof, wherein one of the legs 26*c*, 28*c* abuts the respective blade 22, 24 proximal the load strap 18 and the other of the legs 26*d*, 28*d* abuts the respective blade 22, 24 proximal the line strap 16. Leaf spring legs 26*c*, 28*c* each define a slot 26*e*, 28*e* for engagement with the pivot 20, so as to prevent rotation of the blade springs 26, 28 relative to the respective blades 22, 24.

The blade extension 30 is designed for coupling to a known switch bailing mechanism, which is not shown, and thus provides the motive force necessary to open and close the switch 10. The bailing mechanism is manipulated by an external actuation device, such as an operator handle.

The housing portions 12, 14 are secured together with cap screws 38 and nuts and washers 40, though it should be understood that other types of fasteners may be utilized, such as for example rivets, screws or by bonding the two housing portions together.

Switch 10 also has a plurality of arc plates 42, that assist extinguishment of electrical arcs which may form between the blades 22, 24 and line strap 16 during transient current flow as the switch is being opened or closed.

If desired, switch 10 may be provided with wiring lugs, such as line side lug 44, which is retained to the line strap 16 by threaded fasteners 46. If the switch is intended to be used in a fused application, it may be fitted with a fuse holder 48 which is coupled to the load strap 18 by fasteners 50, spring loaded fuse holder or any device securing the fuse contact.

The switch 10 operates as follows. When the switch 10 is in the "open" position, the blades 22, 24 are positioned above and clockwise relative to the line strap 16; The blade springs 26, 28 are relatively less biased than when the switch 10 is in the "closed" position, because the blades 22, 24 are biased inwardly into free space with no resistance from the line strap 16. It thus follows that the relatively less biased blade springs 26, 28 exert less biasing pressure on the blades 22, 24 at their end which is pivotally coupled to the load strap 18 proximal the load side pivot 20. Thus physical effort necessary to pivot the blades 22, 24 is relatively low when they are not in contact with the line strap 16.

When the blade extension 30 is translated to actuate the switch from the "open" position to the "closed" position, the blades 22, 24 engage and override a bevelled portion 52 of the line strap 16, and in doing so urges the blades outwardly against the blade spring 26, 28 biasing pressure resistance. The spring 26, 28 biasing pressure urges the blades 22, 24 into relatively higher contact pressure with the line side strap 16 as well as the load side strap 18. Thus, the blades 22, 24 exert relatively lower contact pressure against the line and load straps 16, 18 when the switch 10 is in the "open" or "off" position than when it is in the "closed" or "on" position.

While this description of the preferred embodiment is presented to enable those skilled in that art to practice the present invention, it is in no way intended to restrict the scope of the present invention as recited in the claims herein.

What is claimed is:

1. An electrical switch, comprising:

a housing;

first and second spaced apart straps, coupled to the housing;

at least one blade having a first end pivotally coupled to the first strap, the blade capable of relative pivotal movement from an open position spaced from the second strap to a closed position having a second end in contact therewith; and a biasing element coupled to the blade, which biases the ends of the blade inwardly toward the first and second straps at a first bias force level when the blade is in the closed position and inwardly at a second, lower bias force level when the blade is in the open position, wherein the biasing element does not bias the blade between the straps.

2. The electrical switch of claim 1, wherein the biasing element is coupled to the blade between the straps.

3. The electrical switch of claim 1, wherein the biasing element is a leaf spring.

4. The electrical switch of claim 3, further comprising a fastener slidably passing through the blade and the leaf spring.

5. The electrical switch of claim 4, wherein the leaf spring has a central portion which defines a bore for passage of the fastener therethrough and has a pair of legs projecting from the central portion thereof, wherein one of the legs abuts the respective blade proximal the first strap and the other of the legs abuts the respective blade proximal the second strap.

6. The electrical switch of claim 5, wherein the first strap has a pivot mounted thereon for pivotal coupling to the respective blade and the one of the leaf spring legs defines a slot for engagement with the pivot.

7. The electrical switch of claim 4, further comprising a blade extension coupled to the fastener for pivotally moving the blade between the open and closed positions.

8. An electrical switch, comprising:

a housing;

first and second spaced apart straps, coupled to the housing;

a pair of opposed blades having first ends pivotally coupled to and straddling the first strap, which blades are capable of relative pivotal movement from an open position spaced from the second strap to a closed position having seconds ends in contact therewith; and at least one biasing element, coupled to a respective blade, which biases the ends of the respective blade inwardly toward the first and second straps at a first bias force level when the respective blade is in the closed position and inwardly at a second, lower bias force level when the respective blade is in the open position, wherein the biasing element does not bias the respective blade between the straps.

9. The electrical switch of claim 8, wherein the biasing element is coupled to the respective blade between the straps.

10. The electrical switch of claim 8, wherein the biasing element is a leaf spring.

11. The electrical switch of claim 10, further comprising a fastener slidably passing through the respective blade and the leaf spring.

12. The electrical switch of claim 11, wherein the leaf spring has a central portion which defines a bore for passage of the fastener therethrough and has a pair of legs projecting from the central portion thereof, wherein one of the legs abuts the respective blade proximal the first strap and the other of the legs abuts the respective blade proximal the second strap.

13. The electrical switch of claim 12, wherein the first strap has a pivot mounted thereon for pivotal coupling to the respective blade and the one of the leaf spring legs defines a slot for engagement with the pivot.

14. The electrical switch of claim 11, further comprising a blade extension coupled to the fastener for pivotally moving the pair of blades between the open and closed positions.

15. The electrical switch of claim 8, wherein the second strap has a bevelled portion for abutment against each blade when the blade is being moved to the on position in contact with the second strap.

16. An electrical switch, comprising:

a housing;

first and second spaced apart straps, coupled to the housing;

a pair of opposed blades pivotally coupled to and straddling the first strap, which blades are capable of relative pivotal movement from an open position spaced from the second strap to a closed position in contact with and straddling the second strap;

first and second biasing elements, each coupled to a respective blade, each of which biases the respective blade inwardly toward the first and second straps at a first bias force level when the respective blade is in the closed position and inwardly at a second, lower bias force level when the respective blade is in the open position;

a fastener slidably passing through each of the blades, the blade extension and the biasing elements; and a blade extension coupled to the fastener for pivotally moving the pair of blades between the open and closed positions.

17. The electrical switch of claim 16, wherein at least one of the biasing elements is a leaf spring.

18. The electrical switch of claim 17, wherein the leaf spring has a central portion which defines a bore for passage of the fastener therethrough and has a pair of legs projecting from the central portion thereof, wherein one of the legs abuts the respective blade proximal the first strap and the other of the legs abuts the respective blade proximal the second strap.

19. The electrical switch of claim 18, wherein the first strap has a pivot mounted thereon for pivotal coupling to the respective blade and the one of the leaf spring legs defines a slot for engagement with the pivot.

20. The electrical switch of claim 16, wherein the second strap has a bevelled portion for abutment against each blade when the blade is being moved to the on position in contact with the second strap.

* * * * *